United States Patent [19]

Hillstrom

[11] 4,040,223

[45] Aug. 9, 1977

[54] PANEL FRAMING DEVICE AND METHOD

[75] Inventor: David U. Hillstrom, Novi, Mich.

[73] Assignee: Marketing Displays, Inc., Farmington Hills, Mich.

[21] Appl. No.: 691,849

[22] Filed: June 1, 1976

[51] Int. Cl.[2] ..... E04B 1/00

[52] U.S. Cl. ..... 52/483; 52/235

[58] Field of Search ..... 52/460, 474, 475, 476, 52/479, 482, 483, 506, 235

[56] References Cited

U.S. PATENT DOCUMENTS

| | | | |
|---|---|---|---|
| 2,013,763 | 9/1935 | Olsen | 52/483 X |
| 2,048,981 | 7/1936 | Vass | 52/483 X |
| 3,251,168 | 5/1966 | Waring et al. | 52/460 |
| 3,308,590 | 3/1967 | Ettore et al. | 52/483 X |

*Primary Examiner*—J. Karl Bell

[57] ABSTRACT

A panel framing device particularly suited for enclosing unused openings in buildings and the like is disclosed. The framing device comprises a plurality of perimeter and interior framing members adapted to be attached to the building to retain one or more decorative panels therein and to conceal the manner in which they are secured to the building. The interior framing members comprise a cover portion and a base portion which are integrally locked together to prohibit removal thereof.

6 Claims, 5 Drawing Figures

PANEL FRAMING DEVICE AND METHOD

BACKGROUND AND SUMMARY OF THE INVENTION

The present invention relates to devices for attaching signs and decorative panels to existing structures and, in particular, to such devices having concealed means for securing the devices to the structure and having locking means to prevent easy removal thereof.

It is becoming increasingly popular today, particularly due to increased construction and labor costs, to remodel or renovate older buildings and other structures. There are many different ways in which this has been done, from exterior facelifting to complete interior reconstruction.

The present invention provides a relatively uncomplicated and inexpensive means by which an existing building may be updated and revitalized. The present invention combines a unique system of framing members which secure sign and/or decorative panels in place and also conceal the means by which they are attached to the structure.

This invention is particularly suited for converting full-service gasoline station buildings to merely gasoline pumping stations or to buildings which can be used for any other desired purpose. One of the primary problems encountered in converting full-service gasoline stations to buildings for other uses is how to economically and attractively conceal the large service bay openings. Compounding the problem is the desirability of affording a reasonable degree of security to the enclosed or covered area. This necessitates that the means employed should not be easily removable from the outside. The present invention overcomes these problems and, at the same time, provides a decorative and aesthetic structure which is economical to manufacture and install. Apart from improving the appearance and possible uses of existing service stations, the present invention also can be easily applied to any wall surface to conceal unwanted doors, openings, or unsightly wall areas.

Additional advantages and features of the present invention will become apparent from the following description of the preferred embodiment, taken in conjunction with the drawings and claims appended hereto.

DESCRIPTION OF THE PREFERRED EMBODIMENT

Figures 1, 2, 3, 4, 5:
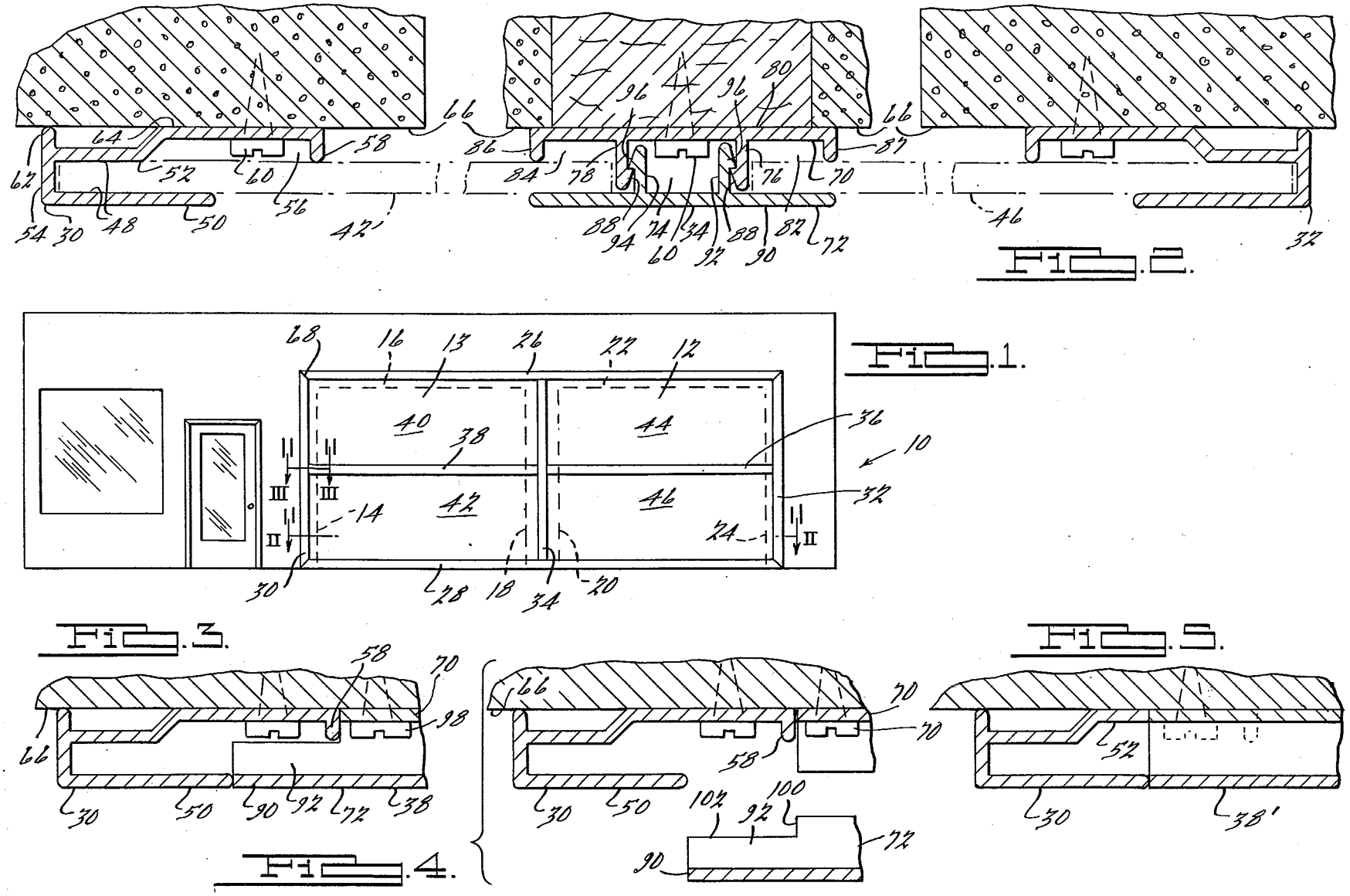
FIG. 1 is a front view of a service station which has been converted by installation of the present invention to conceal the service bay access doors.
FIG. 2 is a cross-section of the installation of FIG. 1 viewed in accordance with Line II—II thereof.
FIG. 3 and 4 illustrate the details of typical junctions between a perimeter framing member and an interior framing member.
FIG. 5 illustrates an alternative corner joint for the perimeter framing members.

Referring now to the drawings, and in particular to FIG. 1, there is shown a typical gasoline service station 10 having two vehicle service bays 12 and 13, which have been effectively concealed by installation of the present invention. The dashed lines 14, 16, 18, 20, 22, and 24 represent the previous service bay openings in the building, access to which is no longer desired. The openings are concealed by a plurality of panels 40, 42,

44 and 46, held in place by a plurality of perimeter (exterior) framing members 26, 28, 30 and 32 and interior framing members 34, 36 and 38. The perimeter framing members consist of an upper member 26, a lower member 28, and two side members 30 and 32 which extend between opposite ends of the upper and lower framing members. In order to reduce the size of the panels to a more manageable size (and to allow concealment of large openings), a vertical interior framing member 34 and two horizontal interior framing members 36 and 38 are provided. The interior framing members 34, 36 and 38 are also necessary in order to allow the panels to be installed in the perimeter framing members 26, 28, 30 and 32 and to conceal the attachment means (as described below). Thus, an interior framing member should be provided at least at one and preferably at two of the four perimeter edges of each panel. In the embodiment shown, four panel members 40, 42, 44 and 46 are held in place by three interior framing members.

The individual framing members are shown in cross section in FIG. 2 which is a sectioned view of the installation of FIG. 1 taken along line II—II thereof. The perimeter framing member 30 which is essentially the same as the other three perimeter members, has a channel 48 into which panel member 42 is inserted. The channel is defined by an exterior sidewall 50 and an interior sidewall 52, each extending inward from an exterior edge portion 54. Interior sidewall 52 extends inward beyond exterior sidewall 50 a short distance and has a second channel 56 formed therein, partially defined by an outwardly facing flange 58 at its terminal edge. The second channel 56 forms a recess to accommodate a plurality of screws 60 or similar fastening devices which secure the framing member to the structure. Exterior edge portion 54 also has a flange 62 extending substantially perpendicular to the sidewalls approximately to the depth of the second channel 56 so as to form a support leg which, along with surface 64 of the second channel, engages surface 66 of the structure to which the framing member 30 is to be mounted. This insures that the first channel 48 and the structure surface 66 will lie in parallel planes. Each of these perimeter framing members have an identical cross sectional shape varying only in length and are mitered at a 45° angle to form a finished right angle corner, as shown at 68 of FIG. 1. Corner angles other than 90° may be similarly formed. Alternatively, if it is not possible or desirable to miter the perimeter framing members, they may easily be joined by coping the end portion of one member to match the abutting contour of the other member and then installing a cap on the exposed outer edge to create a finished corner, or caulking or otherwise sealing the open end portion of the uncut member.

An exemplary interior framing member 34 is also shown in FIG. 2. It is composed of a base 70 and a cover 72 which are adapted to securely interlock together. The base 70 has a center channel section 74 defined by two substantially parallel elongated projections 76 and 78 extending outwardly from a bottom portion 80. Channels 82 and 84 are disposed on either side of the center channel 74 and are defined on their outmost edges by elongated flanges 86 and 87. The flanges 86 and 87 are smaller than the centrally located projections 76 and 78 and form supporting legs to space the panels 42, 46 from the surface 66 of the structure 10. The projections 76, 78 have locking means 88 thereon which in the embodiment shown comprise stepped on hooked projections. The hooks 88 face inwardly for mating with corresponding locking means 96 on the cover.

The cover 72 is comprised of a relatively wide facing portion 90 having two spaced apart substantially parallel elongated projections 92 and 94 which correspond to projections 76, 78 on the base 70. As stated above, each of the projections 92, 94 have locking means 96 thereon which are situated and adapted to mate with hooks 88 on the base 70. As shown in FIG. 2, the projections 76, 78 on the base 70 and projections 92, 94 on the cover 72 are spaced apart such that when the cover 72 is positioned and secured in place on the base 70, the corresponding hooks 88 and 96 interlock to secure the two members together and retain panels 42 and 46 securely in place.

The base 70 is attached to the wall surface 66 by a plurality of screws 60. In this manner, all of the interior framing members 34, 36 and 38 are securely attached to the structure 10. Also, when the covers 72 are snapped into place, the screws 60 are hidden. Similarly, when the panels 40, 42, 44 and 46 are positioned in the perimeter framing members 26, 28, 30 and 32, the screws 60 holding them in place on the structure also are hidden.

Referring now to FIGS. 3 and 4, there is shown a detailed view of a joint between an interior framing member 38 and an exterior framing member 30. As is readily apparent, base member 70 of the interior framing member 38 is secured to wall 66 by screw 98 in an abutting relationship to elongated flange 58 of exterior framing member 30. Since flange 58 is disposed inwardly from the end of flange 50, flange 92 (as well as flange 94, not shown) is notched to allow facing portion 90 of cover 72 to abut flange 50, thereby creating a continuous framing structure. Accordingly, as seen in FIG. 4, cover flange 92 is notched along edges 100 and 102.

An alternative embodiment is shown in FIG. 5. Flange 52 on exterior framing member 30 is notched at the desired location of the intersection with interior framing member 38'. This alternative joint may be particularly desirable for the junction of horizontal interior framing members and vertical perimeter framing members as the vertical perimeter framing members will provide additional support to the horizontal members thereby allowing the use of larger decorative panels.

The framing members of the preferred embodiment are all preferably fabricated from aluminum by an extrusion process, although it is understood that many other suitable materials, such as a plastic composition, steel or wood, may also be used in place thereof. Ideally, both the panels and the exposed surfaces of the framing members are prefinished prior to installation. Preferably, baked enamel coatings are applied to the extruded aluminum framing members to provide a highly durable and attractive product. Also, the framing members can be finished in the same color or pattern as the panels so that the sign or message contained on the panels is unbroken and the framing member are indistinguishable from the panels from a distance.

The panel members will generally be pre-cut and may be of any desired material suitable for the particular location; for example, aluminum sheeting, exterior grade plywood, particle board, or the like. The panels also can be imprinted, either before or after installation, with one or more appropriate advertisements or messages. If desired, the plurality of panels can be combined to form one large single word, picture, or advertisement. As is evident from the panel and framing system shown in FIG. 1, a single message covering one or more bay openings would provide a striking and eyecatching vehicle for the new business at the former full-service gasoline station.

When the panel and framing system is installed over an undesired opening in an existing building 10, the perimeter framing members are first secured to the building. This may be accomplished by installing nails, screws, or other similar anchoring devices in the channels 56 at any desired interval or even by gluing should this be found desirable. Thereafter, the bases 70 of the interior framing members are installed in a like manner including preferably at least one horizontal and one vertical base member. It is understood that any number of vertical or horizontal interior framing members may be used. Next, the panel members are slid into the channels provided in the exterior framing members and set in place resting on the flanges 86, 87 of the interior framing members. Thereafter, the covers 72 are snapped into place in the bases 70 thereby completing the installation, securely holding the panels in place, and covering and hiding the means by which the framing members and panels are secured to the building.

In some applications, such as enclosing gasoline service stations bay doors, there may not be a suitable portion of the structure available for attachmemt of all of the various framing members. In such cases, it will be necessary to provide additional backing structural framing, such as wood two-by-fours or furring strips, to which the framing members of the present invention can be secured. This may be easily accomplished in any suitable conventional manner.

While the present invention has been described with reference to a particular application, it is apparent that various changes, modifications and alterations may be made without departing from the scope thereof, which should be limited only by the claims appended hereto.

I claim:

1. A panel framing device for attachment to a structure and for holding and displaying at least two panel members, said panel framing device comprising a plurality of exterior framing sections forming a perimeter frame, each of said framing sections comprising an elongated channel for engaging and retaining a first edge of one of said panel members, recess means positioned adjacent said channel such that said recess means is covered by a panel member inserted in said channel, and projecting means adjacent said recess means for supporting and positioning said panel member in said channel a predetermined distance from the surface of said structure on which said panel framing device is attached, at least one interior framing means positioned on said structure inwardly of said exterior framing sections, each of said interior framing means comprising a base member and a cover member, said base member havng a pair of outwardly extending spaced apart flange members having inwardly facing toothed portions thereon and a pair of outwardly extending projecting members for supporting said panel members, said pair of flange members forming a recess therebetween, said cover member having inwardly facing toothed flange members for mating and engaging with said first pair of flange members on said base member, said cover member covering said last-mentioned recess when installed in mating engagement with said base member, said cover member and said base member forming a pair of elongated channels in said interior framing means for securely retaining a second edge of said panel members, said cover member adapted to securely mate with said base member and rest against one surface of said panel members, said pair of outwardly extending projecting members on said base member being substantially the same height as said projecting means on said exterior framing sections, said pair of projecting members and said projecting means positioning said panel members substantially parallel to the plane of said surface of said structure, and fastening means disposed in said recess means in said exterior framing sections and in said recess formed in said base member in said interior framing means for securing said panel framing device to said surface of said structure.

2. The panel framing device as set forth in claim 1 wherein said exterior framing sections are mitered at their ends to form finished corners.

3. The panel framing device as set forth in claim 1 wherein a plurality of interior framing means are provided.

4. A panel framing device for attachment to a structure and for holding and displaying at least two panel members, said panel framing device comprising a plurality of exterior framing sections forming a perimeter frame, each of said framing sections comprising an elongated channel for engaging and retaining a first edge of one of said panel members, recess means positioned adjacent said channel such that said recess means is covered by a panel member inserted in said channel, and projecting means adjacent said recess means for supporting and positioning said panel member in said channel a predetermined distance from said structure, at least one interior framing means positioned on said structure inwardly of said exterior framing sections, each of said interior framing means comprising a base member and a cover member, said base member having first engaging means thereon forming a recess therein and a pair of outwardly extending projecting members for supporting said panel members, said cover member having second engaging means thereon for mating and securely engaging with said first engaging means on said base member, said cover member covering said last-mentioned recess when installed in mating engagement with said base member, said cover member and said base member forming a pair of elongated channels in said interior framing means for securely retaining a second edge of said panel members, said cover member adapted to rest against one surface of said panel members when mated with said base member, said pair of outwardly extending projecting members on said base member being substantially the same height as said projecting means on said exterior framing sections, said pair of projecting members and said projecting means positioning said panel members substantially parallel to the plane of the surface of said structure on which said panel framing device is attached, and fastening means disposed in said recess means in said exterior framing sections and in said recess formed in said base member in said interior framing means for securing said panel framing device to said surface of said structure.

5. The panel framing device as set forth in claim 4 wherein said exterior framing sections are mitered at their ends to form finished corners.

6. The panel framing device as set forth in claim 4 wherein a plurality of interior framing means are provided.

* * * * *